US009109182B2

(12) United States Patent
Hartley

(10) Patent No.: US 9,109,182 B2
(45) **Date of Patent: *Aug. 18, 2015**

(54) LUBRICATING OIL COMPOSITION

(71) Applicant: Infineum International Limited, Abingdon (GB)

(72) Inventor: Joseph P. Hartley, Oxford (GB)

(73) Assignee: INFINEUM INTERNATIONAL LIMITED (GB)

( * ) Notice: Subject to any disclaimer, the term of this patent is extended or adjusted under 35 U.S.C. 154(b) by 300 days.

This patent is subject to a terminal disclaimer.

(21) Appl. No.: 13/655,536

(22) Filed: Oct. 19, 2012

(65) Prior Publication Data

US 2013/0288938 A1 Oct. 31, 2013

(30) Foreign Application Priority Data

Oct. 21, 2011 (EP) ..... 11186201

(51) Int. Cl.
*C10M 129/10* (2006.01)
*C10M 129/14* (2006.01)

(52) U.S. Cl.
CPC ..... *C10M 129/10* (2013.01); *C10M 2203/1025* (2013.01); *C10M 2207/023* (2013.01); *C10M 2207/024* (2013.01); *C10M 2207/026* (2013.01); *C10M 2215/064* (2013.01); *C10N 2230/10* (2013.01); *C10N 2240/10* (2013.01)

(58) Field of Classification Search
CPC ..... C10M 2207/023; C10M 2207/024; C10N 2030/10; C10N 2040/104
USPC ..... 508/584, 586, 587
See application file for complete search history.

(56) References Cited

U.S. PATENT DOCUMENTS

| | | | | |
|---|---|---|---|---|
| 2,363,896 | A | 11/1944 | Patterson | |
| 2,388,074 | A | 10/1945 | Patterson et al. | |
| 4,026,867 | A * | 5/1977 | Gardiner | 528/3 |
| 4,059,569 | A * | 11/1977 | Langsley | 528/143 |
| 4,221,673 | A * | 9/1980 | Robson et al. | 508/574 |
| 5,030,692 | A * | 7/1991 | Durairaj | 525/134 |
| 5,910,468 | A * | 6/1999 | Dohhen et al. | 508/332 |
| 6,229,054 | B1 * | 5/2001 | Dai et al. | 568/630 |
| 6,548,459 | B2 * | 4/2003 | Mondal et al. | 508/457 |
| 6,638,898 | B2 * | 10/2003 | Swami et al. | 508/436 |
| 7,427,303 | B2 * | 9/2008 | Sarin et al. | 44/301 |
| 7,473,283 | B2 * | 1/2009 | Tuli et al. | 44/307 |
| 7,789,918 | B2 * | 9/2010 | Tuli et al. | 44/308 |
| 8,263,726 | B2 * | 9/2012 | Dai et al. | 528/31 |
| 8,282,692 | B2 * | 10/2012 | Nair et al. | 44/307 |
| 8,609,599 | B2 * | 12/2013 | Hartley | 508/584 |

OTHER PUBLICATIONS

A. S. Patil, et al., Functional Fluids and Additives based on Vegetable Oils and Natural Products: a Review of the Potential, JSL, Dec. 31, 1998, vol. 15 No. 3, pp. 193-211.

* cited by examiner

*Primary Examiner* — Ellen McAvoy

(57) ABSTRACT

A crankcase lubricating oil composition comprising (A) an oil of lubricating viscosity in a major amount; and (B) an additive component in a minor amount comprising one or more oil-soluble sterically unhindered meta-hydrocarbyl substituted phenols.

12 Claims, No Drawings

LUBRICATING OIL COMPOSITION

FIELD OF THE INVENTION

This invention relates crankcase lubricating oil compositions subject to oxidative degradation.

BACKGROUND OF THE INVENTION

Lubricants (also referred to as lubricant compositions, lubricating oils or lubricating oil compositions), such as those used in a variety of machinery, are susceptible to oxidative deterioration during storage, transportation and usage, particularly when such lubricants are exposed to high temperatures and iron catalytic environments, which greatly promote their oxidation. This oxidation, if not controlled, contributes to the formation of corrosive acidic products, sludge, varnishes, resins and other oil-insoluble products, and may lead to a loss of designated physical and tribological properties of the lubricants. These oxidation products may lead to the formation of harmful deposits on critical engine parts, such as the pistons, piston liners, valves and valve lifters. It is therefore a common practice to include deposit-control and anti-oxidant additives in lubricants to prevent, at least to some extent, oxidation so as to extend their useful life.

"Chemistry and Technology of Lubricants" (second edition) edited by Mortier and Orszulik (ISBN 0 7514 0246 X) describes the inhibition of oxidative degradation of lubricants (section 4.4) and mention radical scavengers as one additive type suitable for this purpose. Among the radical scavengers are mentioned sterically-hindered phenols, exemplified as phenols that are substituted in the 2 and 6 positions with tertiary alkyl groups, the most common of which is the tertiary butyl group. It is stated that optimum protection is achieved when both 2 and 6 positions of the phenol are substituted with tertiary butyl groups and that replacement of a tertiary butyl group by a methyl group in the ortho position reduces the antioxidant activity considerably.

There is interest in providing alternative phenolic lubricants that are derivable from low-cost, widely-available and renewable raw materials. However, these are not indicated by Mortier and Orszulik.

Patil et al describe cashew nut shell liquid as a potential raw material that could be used for the preparation of oxidation inhibitors. They mention cardanol but note that a major drawback in its potential use as an additive is unsaturation in the linear chain. They discuss elimination of the double bonds by hydrogenation, but note the 15-carbon long chain will have poor thermal stability. They describe use of hydrogenated cardanol as an antioxidant in mineral oil, specifically electrical insulating petroleum (or transformed) oils.

UK Patent 626,251 describes use of meta pentadecenyl phenol, in straight chain form (a constituent of cardanol), as an additive to solubilise a metal detergent in an internal combustion engine lubricant. It does not mention the phenol as having anti-oxidancy properties, and notes that oxidation stability may be improved by blending with other additives.

UK Patent 633,188 describes use of minor propositions of distilled cardanol (chiefly metapentadecenyl phenol), in combination with a sulphurised mixture of alkenes, to improve the piston cleanliness performance of crankcase lubricants for automotive engines.

SUMMARY OF THE INVENTION

It has now been found, to ameliorate the above problem, that phenols such as may be obtained from raw materials such as cashew nut shell liquid (CNSL), are, surprisingly, effective as crankcase lubricant anti-oxidants in spite of lacking tertiary alkyl groups in either of the 2 or 6 positions, i.e. the phenols are not sterically hindered in either of those positions.

A first aspect of the invention is a crankcase lubricating oil composition comprising or made by admixing (A) an oil of lubricating viscosity in a major amount; and (B) an additive component in a minor amount comprising, one or more oil-soluble sterically unhindered meta linear pentadecenyl-substituted phenols, which are unfunctionalised or functionalised, such as hydrogenated, the composition comprising less than 0.8 mass % of an aminic anti-oxidant and/or less than 0.5 mass % of a hindered phenolic anti-oxidant, provided that when (B) is unfunctionalised, the composition does not contain a sulphurised mixture of alkenes.

A second aspect of the invention is a method of enabling a passenger car crankcase lubricating oil composition to achieve improved anti-oxidancy performances, which method comprises providing the composition with minor amounts of one or more additives (B) as defined in the first aspect of the invention.

A third aspect of the invention is a method of lubricating surfaces of an internal combustion engine during its operation comprising:

(i) providing, in a minor amount, one or more additives (B) as defined in the first aspect of the invention in a major amount of an oil of lubricating viscosity to make a lubricant, to improve the anti-oxidancy properties of the lubricant;

(ii) providing the lubricant to the crankcase of the internal combustion engine;

(iii) providing a hydrocarbon fuel in the combustion chamber of the engine; and (iv) combusting the fuel in the combustion chamber.

In this specification, the following words and expressions, if used, have the meanings ascribed below:

"active ingredients" or "(a.i.)" refers to additive material that is not diluent or solvent, and all weight or mass percentages expressed herein are based on a.i. content of the additive, and upon the total weight of any additive package;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies;

"hydrocarbyl" means a chemical group of a compound that contains hydrogen and carbon atoms and is bonded to the remainder of the compound directly via a carbon atom. The group may contain one or more atoms other than carbon and hydrogen ("hetero atoms") provided they do not affect the essentially hydrocarbyl nature of the group;

"major amount" means 50 mass % or more of a composition;

"minor amount" means less than 50 mass % of a composition.

Also, it will be understood that various components used, essential as well as optimal and customary, may react under conditions of formulation, storage or use and that the invention also provides the product obtainable or obtained as a result of any such reaction.

Further, it is to be understood that any upper and lower quantity, range and ratio limits set forth herein may be independently combined.

DETAILED DESCRIPTION OF THE INVENTION

The features of the invention relating, where appropriate, to various aspects of the invention will now be described in more detail as follows:

Lubricating Oil Compositions

Lubricating oil compositions useful in the practice of the present invention comprise a major amount of oil of lubricating viscosity and a minor amount of at least one of the phenolic compounds.

Oils of lubricating viscosity useful in the context of the present invention may be selected from natural lubricating oils, synthetic lubricating oils and mixtures thereof. The lubricating oil may range in viscosity from light distillate mineral oils to heavy lubricating oils such as gasoline engine oils, mineral lubricating oils and heavy duty diesel oils. Generally, the viscosity of the oil ranges from 2 to 40, especially from 4 to 20, $mm^2s^{-1}$, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof. Also useful are synthetic oils derived from a gas to liquid process from Fischer-Tropsch synthesized hydrocarbons, which are commonly referred to as gas to liquid, or "GTL," base oils.

Alkylene oxide polymers and interpolymers and derivatives thereof where the terminal hydroxyl groups have been modified by esterification or etherification constitute another class of known synthetic lubricating oils. These are exemplified by polyoxyalkylene polymers prepared by polymerization of ethylene oxide or propylene oxide, and alkyl and aryl ethers of polyoxyalkylene polymers (e.g., methyl-polyisopropylene glycol ether having a molecular weight of 1000 or diphenyl ether of polyethylene glycol having a molecular weight of 1000 to 1500); and mono- and polycarboxylic esters thereof, for example, acetic acid esters, mixed $C_3$-$C_8$ fatty acid esters and $C_{13}$ oxo acid diester of tetraethylene glycol.

Another suitable class of synthetic lubricating oils comprises esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

The oil of lubricating viscosity may comprise a Group I, Group II, or Group III base stock or base oil blends of the aforementioned base stocks. Preferably, the oil of lubricating viscosity is a Group II or Group III base stock, or a mixture thereof, or a mixture of a Group I base stock and one or more of a Group II and Group III. Preferably, a major amount of the oil of lubricating viscosity is a Group II, Group III, Group IV or Group V base stock, or a mixture thereof. The base stock, or base stock blend preferably has a saturate content of at least 65, more preferably at least 75, such as at least 85, % by weight. Most preferably, the base stock, or base stock blend, has a saturate content of greater than 90%. Preferably, the oil or oil blend will have a sulfur content of less than 1, preferably less than 0.6, and most preferably less than 0.4, % by weight.

Preferably the volatility of the oil or oil blend, as measured by the Noack volatility test (ASTM D5880), is less than or equal to 30, preferably less than or equal to 25, more preferably less than or equal to 20, most preferably less than or equal 16, %. Preferably, the viscosity index (VI) of the oil or oil blend is at least 85, preferably at least 100, most preferably from about 105 to 140.

Definitions for the base stocks and base oils in this invention are the same as those found in the American Petroleum Institute (API) publication "Engine Oil Licensing and Certification System," Industry Services Department (14th Ed., December 1996), Addendum 1, December 1998. Said publication categorizes base stocks as follows:

(a) Group I base stocks contain less than 90 percent saturates and/or greater than 0.03 percent sulfur and have a viscosity index greater than or equal to 80 and less than 120 using the test methods specified in Table 1.

(b) Group II base stocks contain greater than or equal to 90 percent saturates and less than or equal to 0.03 percent sulfur and have a viscosity index greater than or equal to 80 and less than 120 using the test methods specified in Table 1.

(c) Group III base stocks contain greater than or equal to 90 percent saturates and less than or equal to 0.03 percent sulfur and have a viscosity index greater than or equal to 120 using the test methods specified in Table 1.

(d) Group IV base stocks are polyalphaolefins (PAO).

(e) Group V base stocks include all other base stocks not included in Groups I, II, III, or IV.

TABLE 1

| Analytical Methods for Base Stock | |
|---|---|
| Property | Test Method |
| Saturates | ASTM D 2007 |
| Viscosity Index | ASTM D 2270 |
| Sulfur | ASTM D 2622 |
| | ASTM D 4294 |
| | ASTM D 4927 |
| | ASTM D 3120 |

Phenolic Compound (B)

The hydrocarbyl group or groups therein may, for example, be linear alkyl or linear alkenyl groups having 12 to 24 carbon atoms.

A characteristic structural feature of the phenolic compounds used in the invention is meta hydrocarbyl-substitution of the aromatic ring where the substituent is attached to the ring at its first (C1) carbon atom. This structural feature is not available by chemical alkyl phenol synthesis such as the Friedel-Crafts reaction of phenol with olefins. The latter typically gives mixtures of ortho and para alkyl phenols (but only around 1% of meta alkyl phenols), and where attachment of the alkyl group to the aromatic ring is at the second (C2) or higher carbon atom.

A second characteristic structural feature of the phenolic compounds used in the invention is that they are sterically unhindered, i.e. they lack tertiary alkyl groups in either of the 2 and 6 positions of the benzene ring relative to a hydroxyl group of the phenolic compound.

Phenolic compounds having the above structural features are, for example, derivable from widely-available and renewable raw materials, such as cashew nut shells. Such shells contain approximately 40% phenolic materials and potentially constitute a low-cost raw material for phenols. Technical cashew nut shell liquid ("Technical CNSL") is the liquid extracted by roasting the shells. Distilling technical CNSL gives rise to "cardanol"; and hydrogenation of cardanol gives rise to a material often referred to as "hydrogenated distilled cashew nut shell liquid."

Cardanol typically contains 3-pentadecylphenol (3%); 3-(8-pentadecenyl) phenol (34-36%); 3-(8,11-pentadecadienyl) phenol (21-22%); and 3-(8,11,14-pentadecatrienyl) phenol (40-41%), plus a small amount of 5-(pentadecyl) resorcinol (c. 10%), also referred to as cardol. Technical CNSL contains mainly cardanol plus some polymerized material. Cardanol may therefore be expressed as containing significant amounts of meta-linear 8-pentadecenyl substituted phenol, where the pentaecenyl group is attached to the aromatic ring at its first carbon atom (C1).

Thus, both cardanol and technical CNSL contain significant quantities of material having long linear unsaturated side chains and only small quantities of material with long linear saturated side chains. It is surprising that cardanol provides lubricants with antioxidising properties since, additional to its lack of hindering groups, the art states that the presence of double bonds is typically bad for this purpose. For example, "Antioxidation and Antioxidants", Volume II. Lundberg Wiley Interscience, page 793 (Chapter 17: "Antioxidation and antioxidants of Petroleum") states: "Compounds containing olefinic double bonds are generally oxidized at a higher rate than the saturated or highly aromatic hydrocarbon."

The present invention may also employ, as an additive, material where a major proportion, preferably all, of the phenol, contains functionalised material, such as with long linear saturated side chains. Such latter material is obtainable by hydrogenating cardanol, completely or partially, as mentioned above; a preferred example is 3-(pentadecyl)phenol, where the pentadecyl group is linear and is attached to the aromatic ring at its first carbon atom. It may constitute 50 or more, 60 or more, 70 or more, 80 or more, or 90 or more, mass % of additive compound (B). It may contain small quantities of 5-(pentadecyl)resorcinol.

The phenolic compounds may, for example, be represented by the general formula

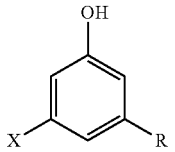

where R is a linear $C_{15}H_{25-31}$ hydrocarbyl group attached to the aromatic nucleus at its C1 position and X is a hydrogen atom or hydroxyl group.

Suitably, the additive component (B) is present in an amount of 0.1 to 10, preferably 0.1 to 5, more preferably 0.1 to 2, mass % of the lubricant, based on the total mass of the lubricant.

Co-Additives

Co-additives, with representative effective amounts in lubricants, that may also be present, different from additive component (B), are listed below. All the values listed are stated as mass percent active ingredient.

| Additive | Mass % (Broad) | Mass % (Preferred) |
|---|---|---|
| Ashless Dispersant | 0.1-20 | 1-8 |
| Metal Detergents | 0.1-15 | 0.2-9 |
| Friction modifier | 0-5 | 0-1.5 |
| Corrosion Inhibitor | 0-5 | 0-1.5 |
| Metal Dihydrocarbyl Dithiophosphate | 0-10 | 0-4 |
| Anti-Oxidants | 0-5 | 0.01-3 |
| Pour Point Depressant | 0.01-5 | 0.01-1.5 |
| Anti-Foaming Agent | 0-5 | 0.001-0.15 |
| Supplement Anti-Wear Agents | 0-5 | 0-2 |
| Viscosity Modifier (1) | 0-6 | 0.01-4 |
| Mineral or Synthetic Base Oil | Balance | Balance |

(1) Viscosity modifiers are used only in multi-graded oils.

The final lubricant, typically made by blending the or each additive into the base oil, may contain from 5 to 25, preferably 5 to 18, typically 7 to 15, mass % of additives, i.e. (B) and any co-additives, the remainder being oil of lubricating viscosity.

The above mentioned co-additives are discussed in further detail as follows; as is known in the art, some additives can provide a multiplicity of effects, for example, a single additive may act as a dispersant and as an oxidation inhibitor.

A dispersant is an additive whose primary function is to hold solid and liquid contaminations in suspension, thereby passivating them and reducing engine deposits at the same time as reducing sludge depositions. For example, a dispersant maintains in suspension oil-insoluble substances that result from oxidation during use of the lubricant, thus preventing sludge flocculation and precipitation or deposition on metal parts of the engine.

Dispersants are usually "ashless", as mentioned above, being non-metallic organic materials that form substantially no ash on combustion, in contrast to metal-containing, and hence ash-forming materials. They comprise a long hydrocarbon chain with a polar head, the polarity being derived from inclusion of e.g. an O, P, or N atom. The hydrocarbon is an oleophilic group that confers oil-solubility, having, for example 40 to 500 carbon atoms. Thus, ashless dispersants may comprise an oil-soluble polymeric backbone.

A preferred class of olefin polymers is constituted by polybutenes, specifically polyisobutenes (PIB) or poly-n-butenes, such as may be prepared by polymerization of a $C_4$ refinery stream.

Dispersants include, for example, derivatives of long chain hydrocarbon-substituted carboxylic acids, examples being derivatives of high molecular weight hydrocarbyl-substituted succinic acid. A noteworthy group of dispersants is constituted by hydrocarbon-substituted succinimides, made, for example, by reacting the above acids (or derivatives) with a nitrogen-containing compound, advantageously a polyalkylene polyamine, such as a polyethylene polyamine. Particularly preferred are the reaction products of polyalkylene polyamines with alkenyl succinic anhydrides, such as described in U.S. Pat. Nos. 3,202,678; 3,154,560; 3,172,892; 3,024,195; 3,024,237, 3,219,666; and 3,216,936, that may be post-treated to improve their properties, such as borated (as described in U.S. Pat. Nos. 3,087,936 and 3,254,025) fluorinated and oxylated. For example, boration may be accomplished by treating an acyl nitrogen-containing dispersant with a boron compound selected from boron oxide, boron halides, boron acids and esters of boron acids.

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps", that is metal salts of acidic organic compounds.

Detergents generally comprise a polar head with a long hydrophobic tail, the polar head comprising a metal salt of an acidic organic compound. The salts may contain a substantially stoichiometric amount of the metal when they are usually described as normal or neutral salts and would typically have a total base number or TBN (as may be measured by ASTM D2896) of from 0 to 80. Large amounts of a metal base can be included by reaction of an excess of a metal compound, such as an oxide or hydroxide, with an acidic gas such as carbon dioxide. The resulting overbased detergent comprises neutralised detergent as an outer layer of a metal base (e.g. carbonate) micelle. Such overbased detergents may have a TBN of 150 or greater, and typically of from 250 to 500 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g. sodium, potassium, lithium, calcium and magnesium. The most commonly-used metals are calcium and magnesium, which may both be present in detergents used in a lubricant, and mixtures of calcium and/or magnesium with sodium.

Particularly preferred metal detergents are neutral and overbased alkali or alkaline earth metal salicylates having a TBN of from 50 to 450, preferably a TBN of 50 to 250. Highly preferred salicylate detergents include alkaline earth metal salicylates, particularly magnesium and calcium, especially, calcium salicylates.

Friction modifiers include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted monoamines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Suitable oil-soluble organo-molybdenum compounds have a molybdenum-sulfur core. As examples there may be mentioned dithiocarbamates, dithiophosphates, dithiophosphinates, xanthates, thioxanthates, sulfides, and mixtures thereof. Particularly preferred are molybdenum dithiocarbamates, dialkyldithiophosphates, alkyl xanthates and alkylthioxanthates. The molybdenum compound is dinuclear or trinuclear.

One class of preferred organo-molybdenum compounds useful in all aspects of the present invention is tri-nuclear molybdenum compounds of the formula $Mo_3S_kL_nQ_z$ and mixtures thereof wherein L are independently selected ligands having organo groups with a sufficient number of carbon atoms to render the compounds soluble or dispersible in the oil, n is from 1 to 4, k varies from 4 through to 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The molybdenum compounds may be present in a lubricating oil composition at a concentration in the range 0.1 to 2 mass %, or providing at least 10 such as 50 to 2,000 ppm by mass of molybdenum atoms.

Preferably, the molybdenum from the molybdenum compound is present in an amount of from 10 to 1500, such as 20 to 1000, more preferably 30 to 750, ppm based on the total weight of the lubricant. For some applications, the molybdenum is present in an amount of greater than 500 ppm.

Anti-oxidants are sometimes referred to as oxidation inhibitors; they increase the resistance of the lubricant to oxidation and may work by combining with and modifying peroxides to render them harmless, by decomposing peroxides, or by rendering an oxidation catalyst inert. Oxidative deterioration can be evidenced by sludge in the lubricant, varnish-like deposits on the metal surfaces, and by viscosity growth.

They may be classified as radical scavengers (e.g. sterically-hindered phenols, secondary aromatic amines, and organo-copper salts); hydroperoxide decomposers (e.g., organosulfur and organophosphorus additives); and multifunctionals (e.g. zinc dihydrocarbyl dithiophosphates, which may also function as anti-wear additives, and organo-molybdenum compounds, which may also function as friction modifiers and anti-wear additives).

Examples of suitable antioxidants, additional to (B) are selected from copper-containing antioxidants, sulfur-containing antioxidants, aromatic amine-containing antioxidants, hindered phenolic antioxidants, dithiophosphates derivatives, metal thiocarbamates, and molybdenum-containing compounds.

Dihydrocarbyl dithiophosphate metals salts are frequently used as antiwear and antioxidant agents. The metal may be an alkali or alkaline earth metal, or is aluminium, lead, tin, zinc molybdenum, manganese, nickel or copper. Zinc salts are most commonly used in lubricants such as in amounts of 0.1 to 10, preferably 0.2 to 2, mass %, based upon the total mass of the lubricant. They may be prepared in accordance with known techniques by first forming a dihydrocarbyl dithiophosphoric acid (DDPA), usually by reaction of one or more alcohols or a phenol with $P_2S_5$, and then neutralising the formed DDPA with a zinc compound. For example, a dithiophosphoric acid may be made by reaction with mixtures of primary and secondary alcohols. Alternatively, multiple dithiophosphoric acids can be prepared where the hydrocarbyl groups on one acid are entirely secondary in character and the hydrocarbyl groups on the other acids are entirely primary in character. To make the zinc salt, any basic or neutral zinc compound could be used but the oxides, hydroxides and carbonates are most generally employed. Commercial additives frequently contain an excess of zinc due to use of an excess of the basic zinc compound in the neutralisation reaction.

Anti-wear agents reduce friction and excessive wear and are usually based on compounds containing sulfur or phosphorous or both, for example that are capable of depositing polysulfide films on the surfaces involved. Noteworthy are the dihydrocarbyl dithiophosphates, such as the zinc dialkyl dithiophosphates (ZDDP's).

Examples of ashless anti-wear agents include 1,2,3-triazoles, benzotriazoles, thiadiazoles, sulfurised fatty acid esters, and dithiocarbamate derivatives.

Rust and corrosion inhibitors serve to protect surfaces against rust and/or corrosion. As rust inhibitors there may be mentioned non-ionic polyoxyalkylene polyols and esters thereof, polyoxyalkylene phenols, and anionic alkyl sulfonic acids.

Pour point depressants, otherwise known as lube oil flow improvers, lower the minimum temperature at which the oil will flow or can be poured. Such additives are well known. Typical of these additive are $C_8$ to $C_{18}$ dialkyl fumerate/vinyl acetate copolymers and polyalkylmethacrylates.

Additives of the polysiloxane type, for example silicone oil or polydimethyl siloxane, can provide foam control.

A small amount of a demulsifying component may be used. A preferred demulsifying component is described in EP-A-330,522. It is obtained by reacting an alkylene oxide with an adduct obtained by reaction of a bis-epoxide with a polyhydric alcohol. The demulsifier should be used at a level not exceeding 0.1 mass % active ingredient. A treat rate of 0.001 to 0.05 mass % active ingredient is convenient.

Viscosity modifiers (or viscosity index improvers) impart high and low temperature operability to a lubricant. Viscosity modifiers that also function as dispersants are also known and may be prepared as described above for ashless dispersants. In general, these dispersant viscosity modifiers are functionalised polymers (e.g. interpolymers of ethylene-propylene post grafted with an active monomer such as maleic anhydride) which are then derivatised with, for example, an alcohol or amine.

The lubricant may be formulated with or without a conventional viscosity modifier and with or without a dispersant viscosity modifier. Suitable compounds for use as viscosity modifiers are generally high molecular weight hydrocarbon polymers, including polyesters. Oil-soluble viscosity modifying polymers generally have weight average molecular weights of from 10,000 to 1,000,000, preferably 20,000 to 500,000, which may be determined by gel permeation chromatography or by light scattering.

Fully Formulated Oils

Fully formulated passenger car diesel engine lubricating oil (PCDO) compositions of the present invention preferably have a sulfur content of less than 0.4, such as less than 0.35, more preferably less than 0.03, such as less than 0.15, mass %. Preferably, the Noack volatility of the fully formulated PCDO (oil of lubricating viscosity plus all additives) will be no greater than 13, such as no greater than 12, preferably no greater than 10. Fully formulated PCDOs of the present invention preferably have no greater than 1200, such as no greater than 1000, or no greater than 800, ppm of phosphorus. Fully formulated PCDOs of the present invention preferably have a sulfated ash (SASH) content of 1.0 mass % or less.

Fully formulated heavy duty diesel engine (HDD) lubricating oil compositions of the present invention preferably have a sulfur content of less than 1.0, such as less than 0.6, more preferably less than 0.4, such as less than 0.15, mass %. Preferably, the Noack volatility of the fully formulated HDD lubricating oil composition (oil of lubricating viscosity plus all additives) will be no greater than 20, such as no greater than 15, preferably no greater than 12. Fully formulated HDD lubricating oil compositions of the present invention preferably have no greater than 1600, such as no greater than 1400, or no greater than 1200, ppm of phosphorus. Fully formulated HDD lubricating oil compositions of the present invention preferably have a sulfated ash (SASH) content of 1.0 mass % or less.

Concentrates

It may be desirable, although not essential, to prepare one or more additive concentrates comprising additives (concentrates sometimes being referred to as additive packages) whereby several additives can be added simultaneously to the oil to form the lubricating oil composition.

The final composition may employ from 5 to 25, preferably 5 to 18, typically 10 to 15, mass % of the concentrate, the remainder being oil of lubricating viscosity and viscosity modifier.

Engine

The invention is applicable to a range of internal combustion engines such as compression-ignited and spark-ignited two- or four-cylinder reciprocating engines. Examples include engines for passenger cars, light commercial vehicles and heavy duty on-highway trucks; engines for aviation, power-generation, locomotive and marine equipment; and heavy duty off-highway engines such as may be used for agriculture, construction and mixing.

EXAMPLES

The present invention is illustrated by but in no way limited to the following examples.

Components

The following components are used:

Component (B1): distilled technical CNSL or "cardanol" (ex Palmer International);

Component (B2): 3-pentadecyl phenol (ex Sigma Aldrich)

Hindered phenol: a commercial hindered phenol antioxidant

Aminic: a commercial alkylated diarylamine antioxidant

Basestock: a commercial alkylated diarylamine antioxidant

Lubricating oil: a passenger car motor oil

Basestock: a group II base oil

Lubricants

Selections of the above components were blended to give a range of crankcase lubricating oil compositions. The engine oil formulation used in the tests contained the following components that are commercially available. There is no particular restriction on the type and exact composition of the materials in the context of the present invention. The test formulation is given below Composition Base Oil Overbased detergents Antiwear Succinimide dispersant VI improver Friction Modifier Secondary diaryl amine antioxidant subject to any changes noted under the "RESULTS" heading below.

As a baseline comparison, one lubricant lacked a phenolic antioxidant. Other lubricants contained one of the phenolic components (B1) and (B2); those containing (B1) and (B2) are of the invention, and the other is a reference example. The lubricants were otherwise identical. The quantitative compositions of the lubricants are shown in the tables below under the "RESULTS" heading.

Testing

Each lubricant was evaluated for its antioxidancy performance in the Mid-High Temperature Thermo-Oxidation Engine Oil Simulation Test (MHT4-TEOST), part of the ILSAC GF-3, GF-4 and GF-5 specification, whose stated purpose is to measure the tendency of the lubricant to form deposits. It is however an antioxidancy test since deposits start to form when the antioxidant becomes depleted.

The test determines the mass of deposit formed on a specially constructed steel rod by continuously stressing a repetitive passage of test oil (8.5 g) under thermal-oxidative and catalytic conditions. The tests were carried out using an instrument manufactured by Tannas Co having a typical repeatability of 0.15 (x+16) mg where x is the mean of two or more repeated test results. A lower deposits mass indicates a better lubricant oxidation stability.

Results

The results are summarized in the tables below:

TABLE 1

Each lubricant contained 99 mass % of lubricating oil. Also, they included a sulfurised olefin. Amounts of basestock and phenol are expressed as mass % and the deposits mass expressed in mg.

| Lubricant | | | |
|---|---|---|---|
| Example | Basestock | Phenol | Deposits |
| Baseline | 1 | — | 88 |
| 1.1 | 0.7 | 0.3 (B1) | 63.7 |
| 1.2 | 0.7 | 0.3 (B2) | 70.3 |
| 2.1 | 0.3 | 0.7 (B1) | 43 |
| 2.2 | 0.3 | 0.7 (B2) | 62.5 |
| 3.1 | 0 | 1 (B1) | 28.6 |
| 3.2 | 0 | 1 (B2) | 59.7 |

The results show that each of the phenol-containing lubricants, i.e. containing B1 and B2 performs better than the baseline, indicating anti-oxidancy activity. This is surprising as neither B1 nor B2 is a hindered phenol, hindering of the hydroxyl group being regarded in the art as necessary for crankcase lubricant antioxidancy activity.

TABLE 2

Each lubricant contained 98.3 mass % of lubricating oil and various amounts of B1, hindered phenol and aminic antioxidants expressed as mass %. The balance is made up to 100% using the same base oil as in Table 1. Deposit mass is expressed in mg.

| | Additives | | | |
|---|---|---|---|---|
| Example | Aminic | Hindered Phenol | B1 | Deposits |
| Baseline | — | — | — | 83.7 |
| 4 (ref) | 0.7 | 0.8 | — | 33.4 |
| 4.1 | 0.7 | — | 0.8 | 20.5 |
| 5 (ref) | — | 1 | — | 72.7 |
| 5.1 | — | — | 1 | 56.2 |

The results of Examples 4 (ref) and 4.1 show that, substituting B1 for the hindered phenol in an aminic-containing lubricant, improved antioxidancy. The results of Examples 5 (ref) and 5.1 show that substituting B1 for the hindered phenol in an aminic-free lubricant also improved antioxidancy.

What is claimed is:

1. A crankcase lubricating oil composition comprising or made by admixing (A) an oil of lubricating viscosity in a major amount; and (B) an additive component in a minor amount comprising, one or more oil-soluble sterically unhindered meta linear pentadecenyl-substituted phenols, which are unfunctionalised or functionalised, the composition comprising less than 0.8 mass % of an aminic antioxidant and/or less than 0.5 mass % of a hindered phenolic anti-oxidant, provided that when (B) is unfunctionalised, the composition does not contain a sulphurised mixture of alkenes.

2. A composition as claimed in claim 1 where the meta substituent is an 8-pentadecenyl or a pentadecyl group.

3. A composition as claimed in claim 1 where (B) comprises distilled cashew nut shell liquid (or cardanol) or hydrogenated distilled cashew nut shell liquid.

4. A composition as claimed in claim 2 where (B) comprises distilled cashew nut shell liquid (or cardanol) or hydrogenated distilled cashew nut shell liquid.

5. A composition as claimed in claim 1 where (B) is a mixture of oil-soluble phenolic compounds comprising 50 or more mass % of one or more of the sterically unhindered meta substituted phenols.

6. A composition as claimed in claim 5 where (B) is a mixture of oil-soluble phenolic compounds comprising 70 or more mass % of one or more of the sterically unhindered meta substituted phenols.

7. A composition as claimed in claim 6 where (B) is a mixture of oil-soluble phenolic compounds comprising 90 or more mass % of one or more of the sterically unhindered meta substituted phenols.

8. A composition as claimed in claim 1 where the phenol has the formula:

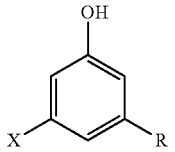

where R is a linear $C_{15}H_{25-31}$ hydrocarbyl group attached to the aromatic nucleus at its C1 position and X is a hydrogen atom or a hydroxy group.

9. A composition as claimed in claim 8 further including one or more other additive components, different from (B).

10. A composition as claimed in claim 9 where the other additives, different from (B), are selected from one or more ashless dispersants, metal detergents, corrosion inhibitors, antioxidants, pour point depressants, antiwear agents, friction modifiers, demulsifiers, antifoam and viscosity modifiers.

11. A method of enabling a passenger car crankcase lubricating oil composition to achieve improved anti-oxidancy performance, which method comprises providing the composition with minor amounts of one or more additives (B) as defined in claim 1.

12. A method of lubricating surfaces of an internal combustion engine during its operation comprising:

(i) providing, in a minor amount, one or more additives (B) as defined in claim 1 in a major amount of an oil of lubricating viscosity to make a lubricant, to improve the anti-oxidancy properties of the lubricant;

(ii) providing the lubricant to the crankcase of the internal combustion engine;

(iii) providing a hydrocarbon fuel in the combustion chamber of the engine; and (iv) combusting the fuel in the combustion chamber.

* * * * *